US011026864B2

(12) United States Patent
Kriheli et al.

(10) Patent No.: US 11,026,864 B2
(45) Date of Patent: Jun. 8, 2021

(54) CONNECTOR SECTION

(71) Applicant: EQUASHIELD MEDICAL LTD., Tefen Industrial Park (IL)

(72) Inventors: Marino Kriheli, Tel Aviv (IL); Eric Shem-Tov, Ramat Hasharon (IL)

(73) Assignee: EQUASHIELD MEDICAL LTD., Tefen Industrial Park (IL)

( * ) Notice: Subject to any disclaimer, the term of this patent is extended or adjusted under 35 U.S.C. 154(b) by 496 days.

(21) Appl. No.: 16/062,425

(22) PCT Filed: Dec. 20, 2016

(86) PCT No.: PCT/IL2016/051357
§ 371 (c)(1),
(2) Date: Jun. 14, 2018

(87) PCT Pub. No.: WO2017/109776
PCT Pub. Date: Jun. 29, 2017

(65) Prior Publication Data

US 2019/0000718 A1 Jan. 3, 2019

(30) Foreign Application Priority Data

Dec. 22, 2015 (IL) ..... 243108

(51) Int. Cl.
*A61J 1/20* (2006.01)

(52) U.S. Cl.
CPC ..... *A61J 1/2096* (2013.01); *A61J 1/201* (2015.05); *A61J 1/2051* (2015.05); *A61J 1/2055* (2015.05);
(Continued)

(58) Field of Classification Search
CPC ..... A61J 1/2051; A61J 1/2027; A61J 1/2065; A61J 1/2096; A61J 1/201; A61J 1/2055; A61J 1/2075; A61J 1/2013
See application file for complete search history.

(56) References Cited

U.S. PATENT DOCUMENTS 4,564,054 A 1/1986 Gustaysson
5,060,704 A 10/1991 Rohrbough
(Continued)

FOREIGN PATENT DOCUMENTS

CN 102784058 A 11/2012
CN 103501751 A 1/2014
(Continued)

OTHER PUBLICATIONS

International Preliminary Report on Patentability for PCT/IL2016/051357—corrected version, dated May 31, 2018—20 pages.
(Continued)

*Primary Examiner* — Leslie R Deak
(74) *Attorney, Agent, or Firm* — Roach, Brown, McCarthy & Gruber, P.C.; Kevin D. McCarthy

(57) ABSTRACT

A locking element for a connector configured to connect two components of a fluid transfer system and a connector that comprises the locking element are described. The connector comprising the locking element is configured to provide continuous fluid channels between a first component and a second component of a fluid transfer system, the fluid is a hazardous drug and the connector is designated for safe and contamination-free transfer of said hazardous drug from first to second container while isolating the needle tips and causing no dangerous and harmful leaks.

8 Claims, 11 Drawing Sheets

(52) U.S. Cl.
CPC ..... *A61J 1/2065* (2015.05); *A61J 1/2013* (2015.05); *A61J 1/2075* (2015.05)

(56) References Cited

U.S. PATENT DOCUMENTS

| | | | | |
|---|---|---|---|---|
| 6,070,623 | A | 6/2000 | Aneas | |
| 6,258,078 | B1 | 7/2001 | Thilly | |
| 6,378,714 | B1 | 4/2002 | Jansen et al. | |
| 8,122,923 | B2 | 2/2012 | Kraus | |
| 8,196,614 | B2 * | 6/2012 | Kriheli | A61M 5/162 141/5 |
| 8,267,127 | B2 | 9/2012 | Kriheli | |
| 9,381,135 | B2 | 7/2016 | Reynolds et al. | |
| 10,376,654 | B2 | 8/2019 | Sanders et al. | |
| 10,596,068 | B2 | 3/2020 | Okiyama et al. | |
| 2006/0079834 | A1 | 4/2006 | Tennican | |
| 2006/0259004 | A1 | 11/2006 | Connell | |
| 2010/0241088 | A1 | 9/2010 | Ranalletta | |
| 2013/0066293 | A1 | 3/2013 | Garfield | |
| 2014/0020792 | A1 | 1/2014 | Kraus | |
| 2014/0181320 | A1 | 6/2014 | Farkas | |

FOREIGN PATENT DOCUMENTS

| | | | | |
|---|---|---|---|---|
| IL | 237788 | | 9/2016 | |
| JP | S 60-501294 | A | 8/1985 | |
| JP | 2001-505083 | A | 4/2001 | |
| JP | 2001-508680 | A | 7/2001 | |
| JP | 2003-511212 | A | 3/2003 | |
| JP | 2012192047 | A | 10/2012 | |
| WO | 01/28489 | A1 | 4/2001 | |
| WO | 2014/122643 | | 8/2014 | |
| WO | 2014/181320 | | 11/2014 | |
| WO | WO-2014181320 | A1 * | 11/2014 | A61J 1/2013 |
| WO | 2015/108495 | A1 | 7/2015 | |
| WO | 2015/164365 | A1 | 10/2015 | |
| WO | 2015/166993 | A1 | 11/2015 | |
| WO | 2016042544 | A1 | 3/2016 | |
| WO | 2016147178 | A1 | 9/2016 | |
| WO | 2016199133 | A1 | 12/2016 | |
| WO | 2017183031 | A1 | 10/2017 | |

OTHER PUBLICATIONS

International Search Report for PCT/IL2016/051357, dated Mar. 21, 2017—10 pages.

Written Opinion of the International Searching Authority for PCT/IL2016/051357, dated Mar. 21, 2017—6 pages.

Office action from Chinese patent office in a counterpart foreign application—Chinese Patent Application No. 201680081454.3—dated Jul. 22, 2020 (7 pages); corresponding search report (3 pages); machine English translation of office action (5 pages).

Communication and Supplementary European Search Report for EP 16 87 7898—a counterpart foreign application—dated Jul. 12, 2019; 7 pages.

Office Action from corresponding Japanese Patent Application No. 2018-532571, dated Jan. 19, 2021 (2 pages—English translation—2 pages).

* cited by examiner

CONNECTOR SECTION

FIELD OF THE INVENTION

The present invention relates to the field of fluid transfer devices. More particularly, the invention relates to a connector section for use in contamination-free transfer of a hazardous drug from one container to another.

BACKGROUND OF THE INVENTION

Medical and pharmacological personnel that are involved in the preparation and administration of hazardous drugs suffer the risk of being exposed to drugs and to their vapors, which may escape to the surroundings. As referred to herein, a "hazardous drug" is any injectable material the contact with which, or with the vapors of which, may constitute a health hazard. Illustrative and non-limitative examples of such drugs include, inter alia, cytotoxins, antiviral drugs, chemotherapy drugs, antibiotics, and radiopharmaceuticals, such as herceptin, cisplatinum, fluorouracil, leucovorin, taxol, metatroxat, gemzar, cyclophosphamide, cytoxan, and neosar, or a combination thereof, in a liquid, solid, or gaseous state.

Hazardous drugs in liquid or powder form are contained within vials, and are typically prepared in a separate room by pharmacists provided with protective clothing, a mouth mask, and a laminar flow safety cabinet. A syringe provided with a cannula, i.e. a hollow needle, is used for transferring the drug from a vial. After being prepared, the hazardous drug is added to a solution contained in a bag which is intended for parenteral administration, such as a saline solution intended for intravenous administration.

Since hazardous drugs are toxic, direct bodily contact thereto, or exposure to even micro-quantities of the drug vapors, considerably increases the risk of developing health fatalities such as skin cancer, leukemia, liver damage, malformation, miscarriage and premature birth. Such exposure can take place when a drug containing receptacle, such as a vial, bottle, syringe, and intravenous bag, is subjected to overpressure, resulting in the leakage of fluid or air contaminated by the hazardous drug to the surroundings. Exposure to a hazardous drug also results from a drug solution remaining on a needle tip, on a vial or intravenous bag seal, or by the accidental puncturing of the skin by the needle tip. Additionally, through the same routes of exposure, microbial contaminants from the environment can be transferred into the drug and fluids; thus eliminating the sterility with possibly fatal consequences.

U.S. Pat. No. 8,196,614 to the applicant of the present invention describes closed system liquid transfer systems designed to provide contamination-free transfer of hazardous drugs. The basic innovation in this patent is the provision of two separate channels—one for air and the other for liquid—that allow the differences in pressure within the system to be equalized within the closed system when liquid is transferred from one component, e.g. a syringe, to another component e.g. a drug vial, IV bag, or IV line.

FIG. 1 is a vertical cross sectional view of an embodiment of a contamination-free liquid transfer unit 10 described in U.S. Pat. No. 8,196,614. Liquid transfer unit 10 comprises a syringe 27 and a connector section 25. Syringe 27 comprises a hollow piston rod 30 extending from cap 32 to piston 34, which sealingly engages the inner wall of, and is displaceable with respect to, barrel 24. Piston 34 defines two chambers of variable volume: a distal liquid chamber 38 between piston 34 and connector section 25 and a proximal air chamber 40 between piston 34 and stopper 28 that seals the upper part of the barrel 24. An air conduit 46, which has the form of a hollow needle, passes through piston 34 and extends inside of hollow piston rod 30. Air flowing through conduit 46 enters the interior of piston rod 30 and exits to air chamber 40 through an aperture formed at the distal end of piston rod 30. A second conduit 48, which is considerably shorter than air conduit 46 and has the same structural features, is present to allow a liquid to flow into or out of liquid chamber 38 from a drug vial, IV bag, or IV line that can be attached to the distal end of the connector section.

As shown in FIG. 2, connector section 25 comprises a cylindrical, hollow outer body 128 having a distal shoulder portion 129 radially protruding from body 128 and closed proximal cap 113. The distal shoulder portion 129 terminates with opening 126 through which the proximal end of a fluid transfer component can be inserted for coupling. Connector section 25 also comprises a double membrane seal actuator 130, which is reciprocably displaceable within the interior of body 128. Air conduit 46 and liquid conduit 48 described above pass through the proximal cap 113 and are retained by needle holder 115, which protrudes into interior 119 of connector section 25 from a central portion of closed proximal cap 113.

The double membrane seal actuator 130 comprises a proximal disc shaped membrane 142 having a rectangular cross-section and a distal double disc shaped membrane 143 having a T-shaped cross-section with a rectangular proximal portion 144 and a distal portion 147 disposed radially inwards with respect to proximal portion 144. Membranes 142 and 143 are seated within casing 137, while distal portion 147 protrudes distally from casing 137. Resilient elongated arms 133 and 134 having equal length are substantially longitudinally disposed, being attached at connection points 161' and 162', respectively, to casing 137. Arms 33 and 34 terminate with distal enlarged elements 161 and 162, respectively. The resilient arms 133 and 134 are designed such that, if not prevented from doing so, the distance between enlarged elements 161 and 162 is larger than the interior diameter of body 128 of connector section 25. Enlarged elements 161 and 162 are configured to be received in, and engaged by, shoulder portion 129 when actuator 130 is disposed in a first (distal) position.

Conduits 46 and 48 distally extend from needle holder 115, piercing membrane 142 of actuator 130. The distal ends of conduits 46 and 48 have sharp pointed ends **46*a* and 48*a*, respectively, and are further provided with apertures 111 and 112, respectively, through which fluid is transferred during a fluid transfer operation. The proximal end of air conduit 46 extends within the interior of hollow piston rod 30 and the proximal end of liquid conduit 48 terminates at or slightly proximally from cap 113 of connector section 25, so that the liquid conduit will be in fluid communication with the interior of the liquid chamber of syringe 27. When actuator 130 is in the first (distal) position (as shown in FIG. 1 and FIG. 2), the pointed ends 46*a* and 48*a* of the conduits are retained between membranes 142 and 143, preventing a user from being exposed to, and injured by, the pointed ends and also sealing the ends of conduits 46 and 48 from the surroundings, thereby preventing contamination of the interior of fluid transfer unit 10 and leakage of a harmful drug contained within the interior of unit 10** to the surroundings.

As said, connector section 25 is adapted to be releasably coupled to another fluid transfer component, which can be any fluid container with a standard connector such as a vial adapter connected to a drug vial, a spike adapter inserted into an intravenous bag, or an intravenous line to produce a "fluid transfer assembly", through which a fluid is transferred from the fluid transfer component to the syringe or vice versa. When, for example the proximal membrane enclosure of a vial connector is inserted into opening 126 at the distal end of connector 25, membrane 143 in the connector and a membrane at the proximal end of the vial adapter are pushed together forming a double membrane seal. If the connector and vial adapter continue to be pushed together, double membrane seal actuator 130 moves upwards inside body 128 of the connector and the pointed ends 46*a* and 48*a* of the conduits are pushed through membrane 143 and the membrane in the vial adapter establishing air and liquid channels between the syringe and drug vial via connector section 25 and the vial adapter. With this arrangement two-way transfer of fluids is accomplished by means of a pressure equalization arrangement in which the same volume of the hazardous drug and air are exchanged internally within the fluid transfer assembly.

Since filing U.S. Pat. No. 8,196,614, the applicant has filed several patent applications directed to improvements of the original design of most of the components of the apparatus. One such patent application WO 2014/122643 inter alfa describes changes to the apparatus designed to prevent accidental fluid communication between the air and fluid channels by means of the addition of a filter in the air channel and/or a sleeve through which the tips of the needles slide and also a new design for a vial adapter.

One component in particular that has been the subject of intensive development is the connector section that connects between two components of a drug transfer system, e.g. a syringe and a vial adapter. In particular emphasis has been placed on improved designs of the actuator that houses the septum or membrane. Actuators having various designs and containing either one or two septa have been described, for example in Israeli Patent Application IL237788.

FIG. 3*a*, FIG. 3*b*, and FIG. 3*c* are respectively front, cross-sectional, and exploded views of one embodiment of a septum holder 700 described in IL237788. Septum holder 700 is comprised of a body 702 having a disk shaped annular upper body part 702*a* and a lower body part 702*b*. Two equal length resilient elongated arms 704 are attached to the sides of body 700. The arms terminate with distal enlarged elements 706.

As can be seen in exploded view of FIG. 3*c*, a septum 708 is fitted into the lower body part 702*b* so that it extends downward between arms 704. Septum 708 is made of a single piece of cylindrically shaped resilient material. The upper part of septum 708 has a diameter larger than the middle part in order to form a flange that rests on an annular ledge 702*c* created around the inside of the bottom section 702*b* of body 702 when the middle part of septum 708 slides through the open center at the bottom of bottom section 702*b*. Upper section 702*a* is then pushed onto the lower section in order to connect septum 708 to body 702. The upper and lower sections of body 702 can be held permanently together with the septum 708 held between them by any method known in the art, e.g. press fitting, gluing, snap fitting, ultrasonic forming, and laser or ultrasonic welding.

In an alternative embodiment the septum, shaped as described above can be forced into the circular opening at the bottom of the bottom section 702*b* from below and, when the flange snaps onto annular ledge 702*c* the upper section 702*a* of the body is pushed into the lower section 702*b* to hold the septum in place. In another embodiment, the upper and middle sections of the septum can have the same diameter that is at least as large as the diameter of annular ledge 702*c*. In this embodiment the septum is forced into the lower section 702*b* from the bottom. Because of the flexibility of the material of which the septum is made the upper part of the septum is at first compressed to enter the lower section of the holder and then expands to fill the space on top of ledge 702*c*.

Two bores 710 that function in the same manner as the seat of a needle valve are created part of the way through the height of the middle part of septum 708. The lowest part of septum 708 has a diameter that matches that of the septum in the fluid transfer component, e.g. vial adaptor, to which it will be connected. Note that in FIGS. 3*a* to 3*d* the lower part of the septum is shown as having a diameter less than that of the rest of the septum; however, this is not always necessary and in some cases the lower part of the septum can have the same diameter as the middle part of the septum or the entire septum can have the same diameter. The only condition being that the septum in the septum holder has to be able to contact a septum in a fluid transfer component and form a seal that prevents leakage of air or liquid.

FIG. 3*d* schematically shows the holder of FIG. 3*a*, FIG. 3*b*, and FIG. 3*c* in a syringe connector section of a closed system liquid transfer apparatus. The connector section is essentially the same as that shown in a described in relation to FIG. 2. Cylindrical body 718 of the connector section is attached to syringe 712. Two hollow needles 714, which function as an air conduit, and 716, which functions as a liquid conduit, are fixedly attached to the upper end of body 718 of the connector section. At the lower end of the needles, adjacent to the pointed distal tips, are ports 724 that allow fluid communication between the exterior and the hollow interiors of the needles. External ridges 722 near the bottom of cylindrical body 718 serve as finger grips for use when attaching the connector section and syringe to other elements of the drug transfer system. Ridges 722 are not essential and can be eliminated or replaced with other means, for example a roughened surface area, to accomplish the same purpose.

A septum holder 700 is located inside of cylindrical body 718 of the connector section. As shown, the distal ends of needles 716, 714 are inserted into bores 710 in septum 708. The diameters of bores 710 are smaller than the outer diameter of the shafts of the needles and therefore the resilient material of which the septum is manufactured pushes radially against the shaft of the needle sealing the ports 724. When not connected to another element of the liquid transfer system the distal enlarged elements 706 of arms 704 are engaged in the shoulder portion 720 at the distal end of body 718. As shown in FIG. 3*d*, in this position the tips of the needles are isolated from the outside by septum 708 and the walls of the bores 710 pressing radially on the shafts of the needles prevent fluids from entering or exiting the interior of the needles.

Connection of the syringe connector to a fluid transfer component, e.g. a vial adaptor, a spike adaptor for connection to an IV bag, or a connector for connection to an IV line, is accomplished in the same manner as described herein above. When the septum of the fluid transfer component is pushed against the bottom of septum 708, septum holder 700 begins to move upwards inside body 718 and the tips of the needles begin to exit bores 710 penetrate the solid material of septum 708. The tips of the needles pass through septum 708 and the septum of the fluid transfer component as holder 700 continues to be pushed upwards, thereby establishing air and liquid channels between the element of the liquid transfer system attached to the fluid transfer component and the proximal air chamber and distal liquid chamber in the syringe. When the fluid transfer component is pulled downward to separate it from the connector section, septum holder 700 moves downwards inside body 718 and the tips of the needles are pulled through the solid material of septum 708 and reenter bores 710.

All embodiments of existing connector sections known to the inventor of the present invention, including those that he has invented and those found in other publications, for example U.S. Pat. No. 8,122,923, comprise either one or two septa.

It is a purpose of the present invention to provide a connector section that does not comprise any septa.

Further purposes and advantages of this invention will appear as the description proceeds.

SUMMARY OF THE INVENTION

In a first aspect the invention is a locking element for a connector configured to connect two components of a fluid transfer system. The locking element comprises:

a. a body comprising an upper part having a hollow interior and a lower part having a channel passing through it;

b. a rigid flat annular disc at the free end of the lower part;

c. elongated flexible arms having distal enlarged elements attached to the sides of the upper part of the body and projecting downwards parallel to the sides of lower part of the body; and d. an insert configured to be inserted into the channel, wherein the insert is made of flexible material and comprises at least one bore passing through it which forms a sleeve through which the at least one hollow needle is able to pass.

Embodiments of the locking element comprise two bores through the inset.

In a second aspect the invention is a connector configured to connect two components of a fluid transfer system. The connector comprises:

a. a hollow cylindrical body that has a closed upper end having a connection arrangement on the exterior side of the closed upper end to connect to a first component of a fluid transfer system and a needle holder on the interior side;

b. a locking element according to claim 1, wherein the body of the locking element is surrounded by the cylindrical body and is configured to slide up and down inside the hollow interior of the cylindrical body of the connector;

c. an open lower end of the cylindrical body configured to allow an end of a second component to be inserted into the interior of the cylindrical body;

d. shoulder portions at the open lower end of the cylindrical body into which the enlarged elements of the elongated flexible arms of the locking element fit when the connector is not connected to a second component of a fluid transfer system; and e. at least one hollow needle that passes through the closed end of the cylindrical body of the connector and the hollow interior of the upper part of the body of the locking element and is fixedly attached to the cylindrical body of the connector by the needle holder.

Embodiments of the connector of the invention comprise two hollow needles and two bores through the inset.

Embodiments of the connector of the invention comprise one hollow needle and one bore through the inset.

Embodiments of the connector of the invention comprise one hollow needle and two bores through the inset.

In embodiments of the connector of the invention the hollow needles may have openings near their pointed distal tips configured to allow passage of fluid between the interiors and exteriors of the needles.

In embodiments of the connector of the invention, when the connector is not connected to a second component of a fluid transfer system, the locking element is at the distal end of the cylindrical body of the connector, the distal enlarged elements of the elongated flexible arms of the locking element are fit into shoulder portions at the open lower end of the cylindrical body of the connector, and the tips of the needles are located in the bores in the insert, whereupon the openings in the sides of the needles are blocked by the interior walls of the bores thereby completely isolating the needles from each other and the outside environment preventing passage of fluid between the interiors and exteriors of the needles and exchange of fluid with the surroundings.

In embodiments of the connector of the invention, when the connector is connected to a first component of a fluid transfer system and to a second component of a fluid transfer system that comprises a septum that seals the proximal end of the second component, the septum at the top of the second component is pressed tightly against the annular disc at the distal end of the locking element, the distal enlarged elements of the elongated flexible arms of the locking element are no longer in the shoulder portions at the distal end of the connector but are fit into recesses in the second component locking the locking element and second component together, the locking element is located at or near the proximal end of the interior of the cylindrical body of the connector, and the tips of the needles are pushed out of the bores in the insert of the locking element and through the septum that seals the proximal end of the second component, whereupon the openings in the sides of the needles are no longer blocked by the interior walls of the bores thereby providing continuous fluid channels between the first component and the second component via the interiors of the needles.

All the above and other characteristics and advantages of the invention will be further understood through the following illustrative and non-limitative description of embodiments thereof, with reference to the appended drawings.

DETAILED DESCRIPTION OF EMBODIMENTS OF THE INVENTION

Figure 1:
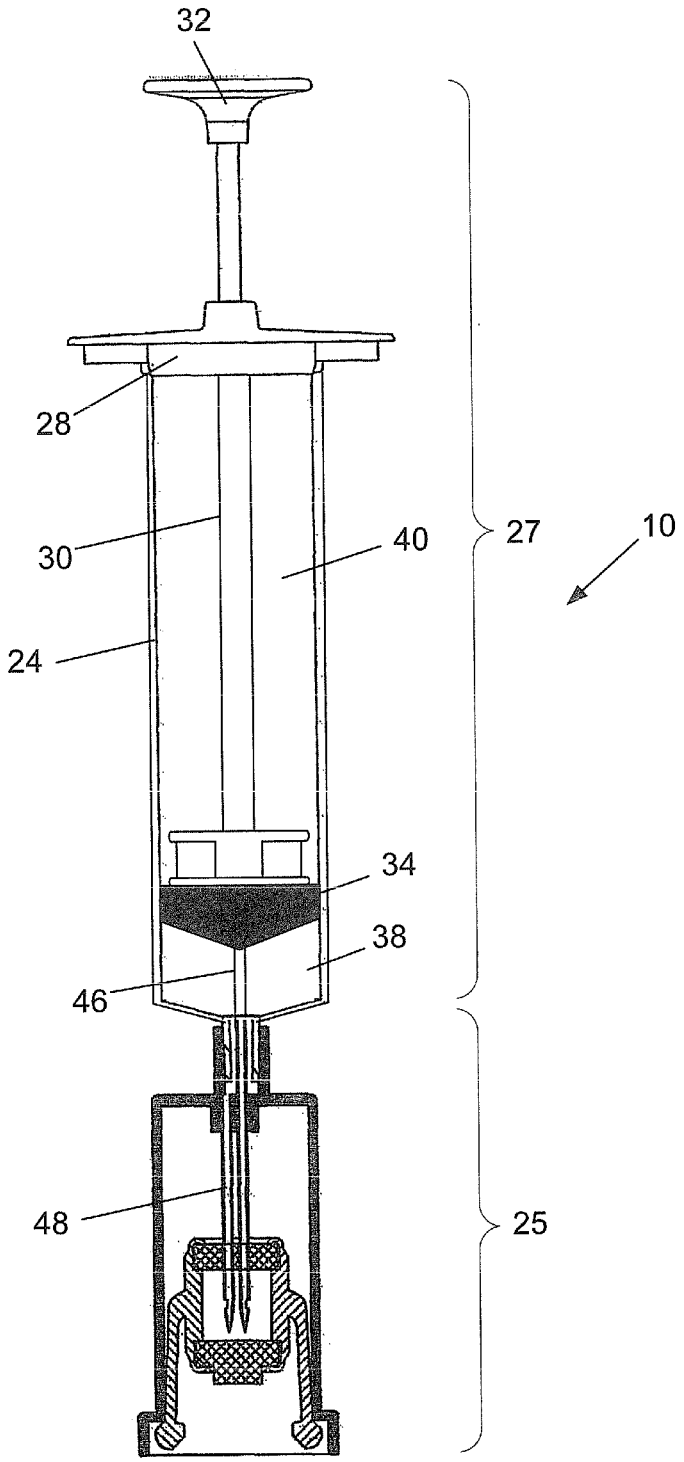
Fig. 1 Prior Art
FIG. 1 is a vertical cross sectional of an embodiment of the contamination-free drug transfer apparatus of the invention described in U.S. Pat. No. 8,196,614.
Figure 2:
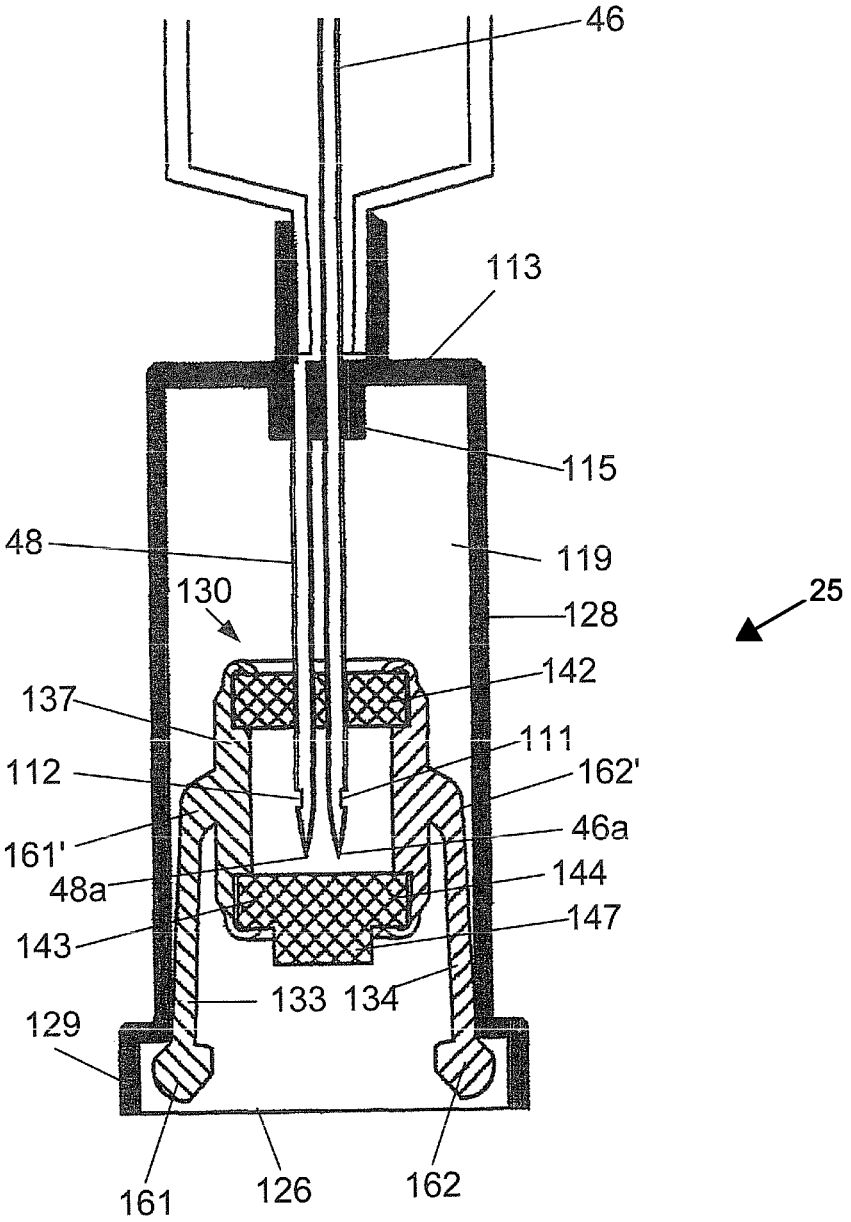
Fig. 2 Prior Art
FIG. 2 is a cross sectional view of the connector section of the embodiment of the contamination-free drug transfer apparatus shown in FIG. 1.
Figure 3A:
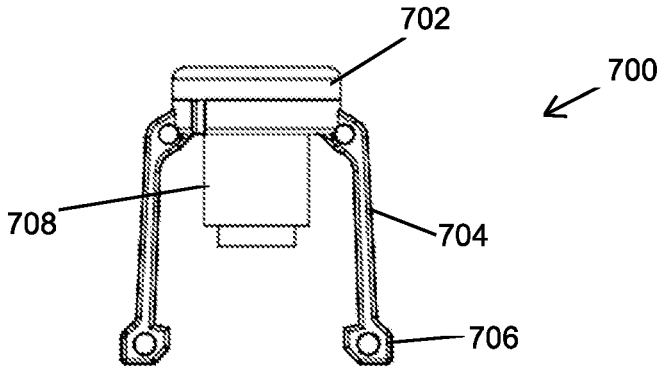
Fig. 3a Prior Art
FIG. 3*a*, FIG. 3*b* and FIG. 3*c* are respectively front, cross-sectional, and exploded views of a first embodiment of a septum holder described in IL237788.
Figure 3B:
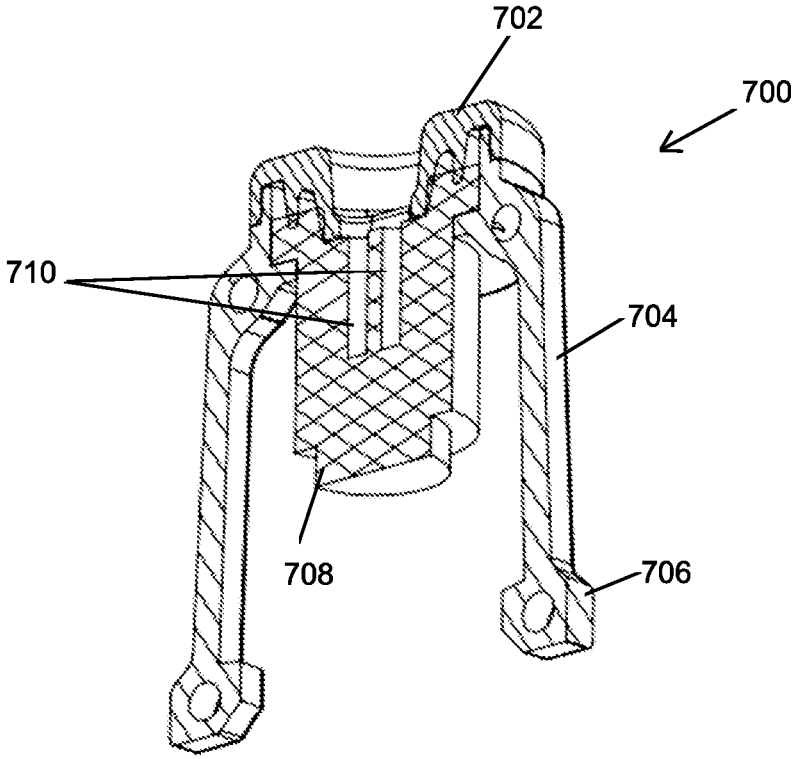
Fig. 3b Prior Art
Figure 3C:
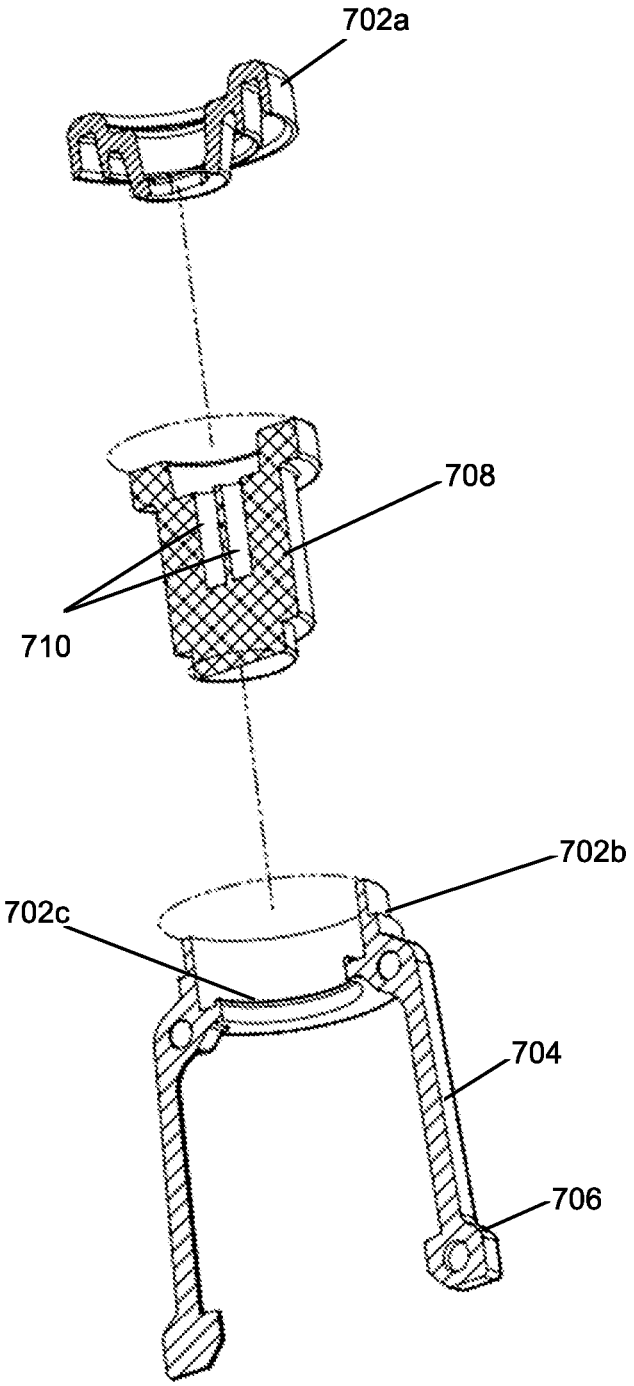
Fig. 3c Prior Art
Figure 3D:
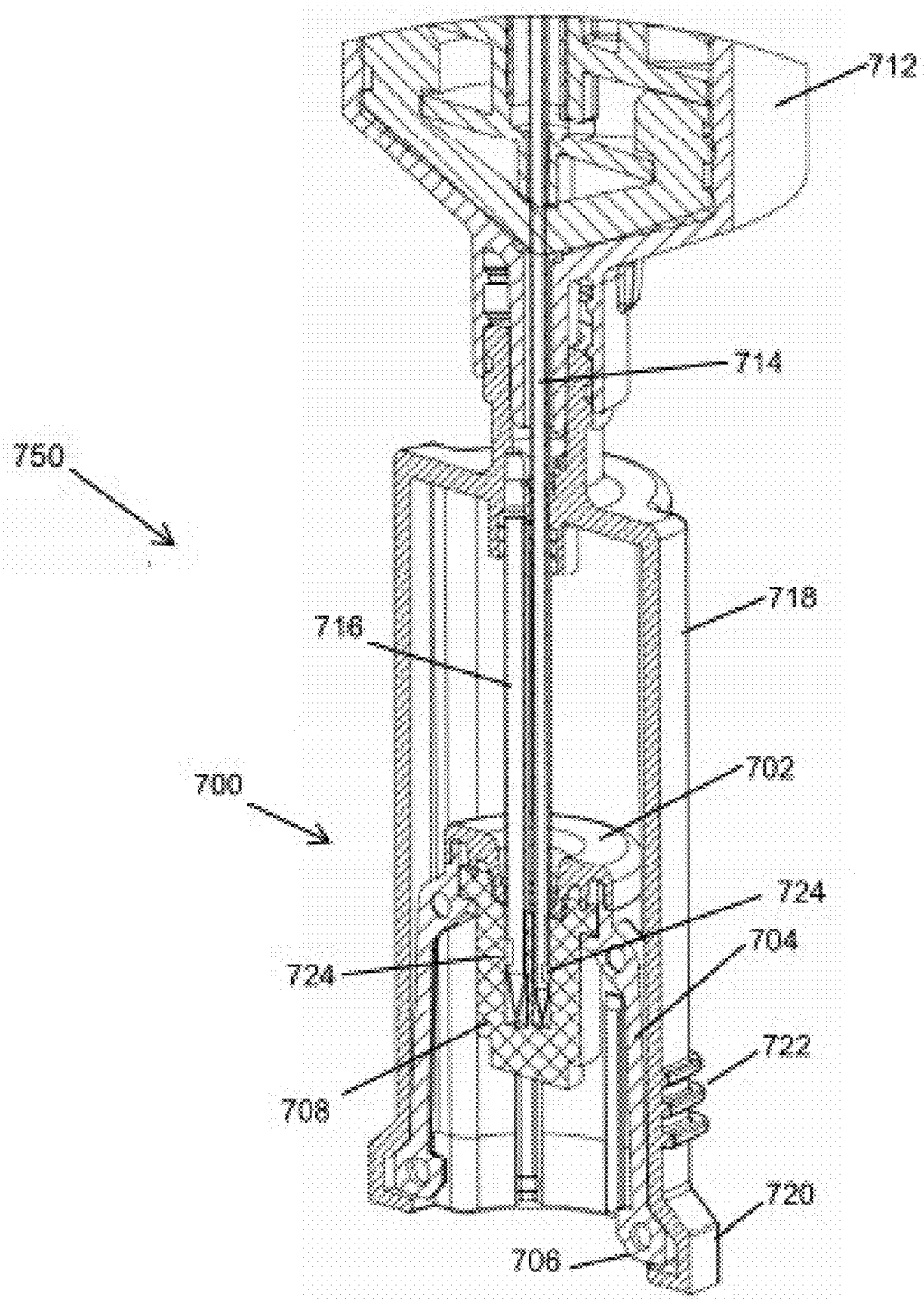
Fig. 3d Prior Art
FIG. 3*d* schematically shows the septum holder of FIG. 3*a* in a connector section similar to that shown in FIG. 2.

The invention is a locking element for a connector configured to connect two components of a fluid transfer system and a connector that comprises the locking element. The connector works on the same principle as that in connectors previously invented by the inventor examples of which are connector 25 shown in FIG. 2 and connector 750 shown in FIG. 3*d*. The locking element of the present invention replaces the double membrane seal actuator 130 in connector 25 and septum holder 700 in connector 750.

The designations "upper" and "lower" used herein are of course relative and are used without reference to the orientation of components in the figures but with reference to how the components would normally be oriented during use.

Figure 4A:
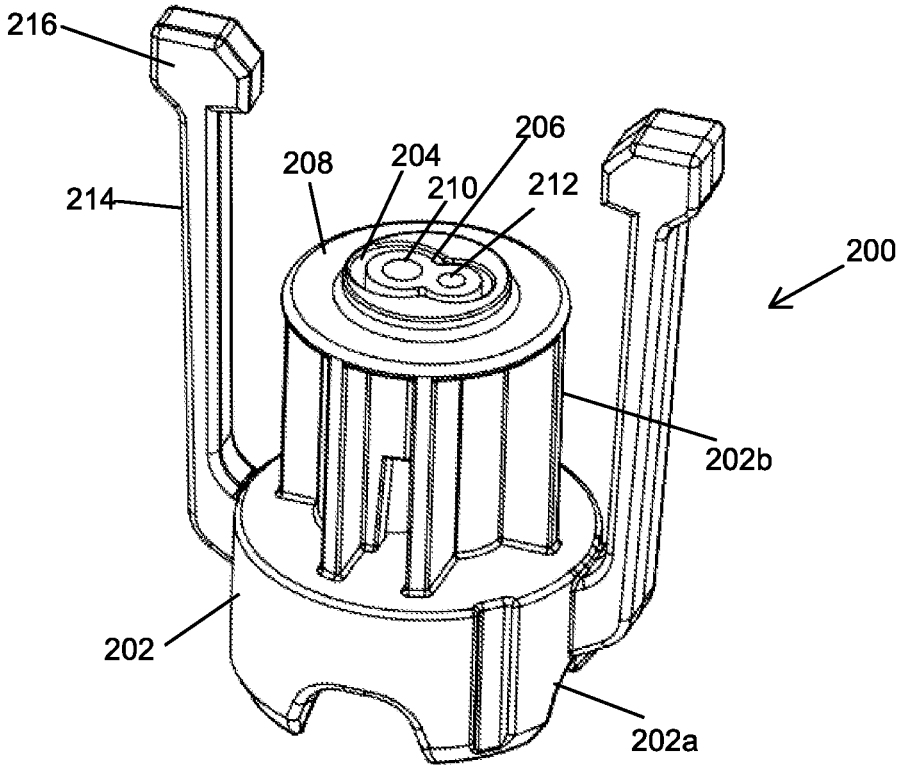
FIG. 4*a* schematically shows an embodiment of a locking element for the connector section of the invention.
Figure 4B:
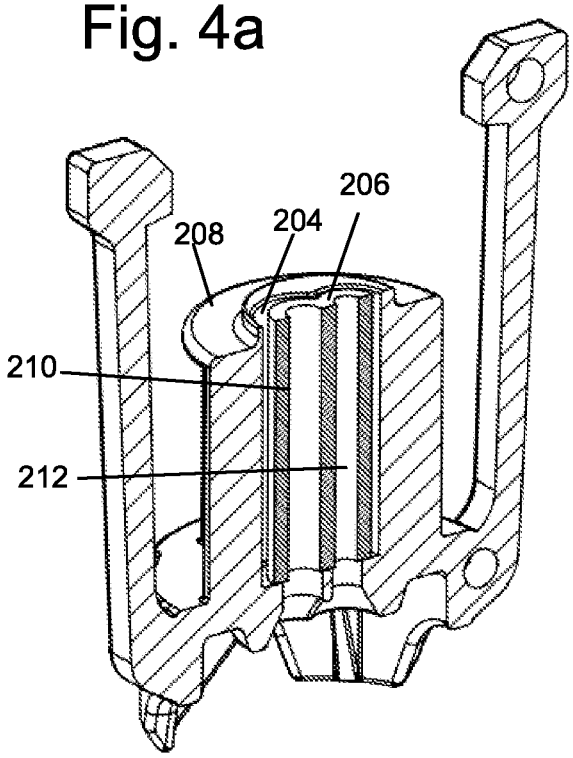
FIG. 4*b* is a cross-sectional view of the locking element shown in FIG. 4*a;*

FIG. 4*a* schematically shows an embodiment of a locking element for the connector section of the invention. FIG. 4*b* is a cross-sectional view of the locking element shown in FIG. 4*a*. Locking element 200 has a body 202 made of either of a single piece of plastic material or of a few pieces of plastic material connected together, for example by welding or gluing, to form a single item. The upper part 202*a* of body 202 has a hollow interior and the lower part 202*b* has a channel 204 passing through it that, in this embodiment, has a cross section with the shape of the numeral eight that is formed by two overlapping bores. The free end of lower part 202*b* comprises a rigid flat annular disc 208. Elongated flexible arms 214 having distal enlarged elements 216 are attached to the sides of the upper part 202*a* of body 202 so that they project downwards parallel to the sides of lower part 202*b* of body 202.

An insert 206 made of resilient material, such as, for instance, silicon or soft PVC, is inserted into channel 204. Insert 206 has two bores 210 and 212 passing through it, which form sleeves through which needles acting as liquid and air channels respectively pass. The insert 206 may, in one embodiment of the invention, be kept in place by friction created by the contact of its outer surface with the inner surface channel 204 or by plastic teeth (not shown) that extend from the channel 204. The friction can be obtained simply by providing an outer diameter of insert 206 that is greater than the diameter of the inner surface of channel 204. Thus, the resilient material of which insert 206 is made is compressed and pushes back toward the inner surface of channel 204. It is also possible to provide a roughening of the outer surface of insert 206, or to provide anchoring elements on either or both surfaces.

Figure 5:
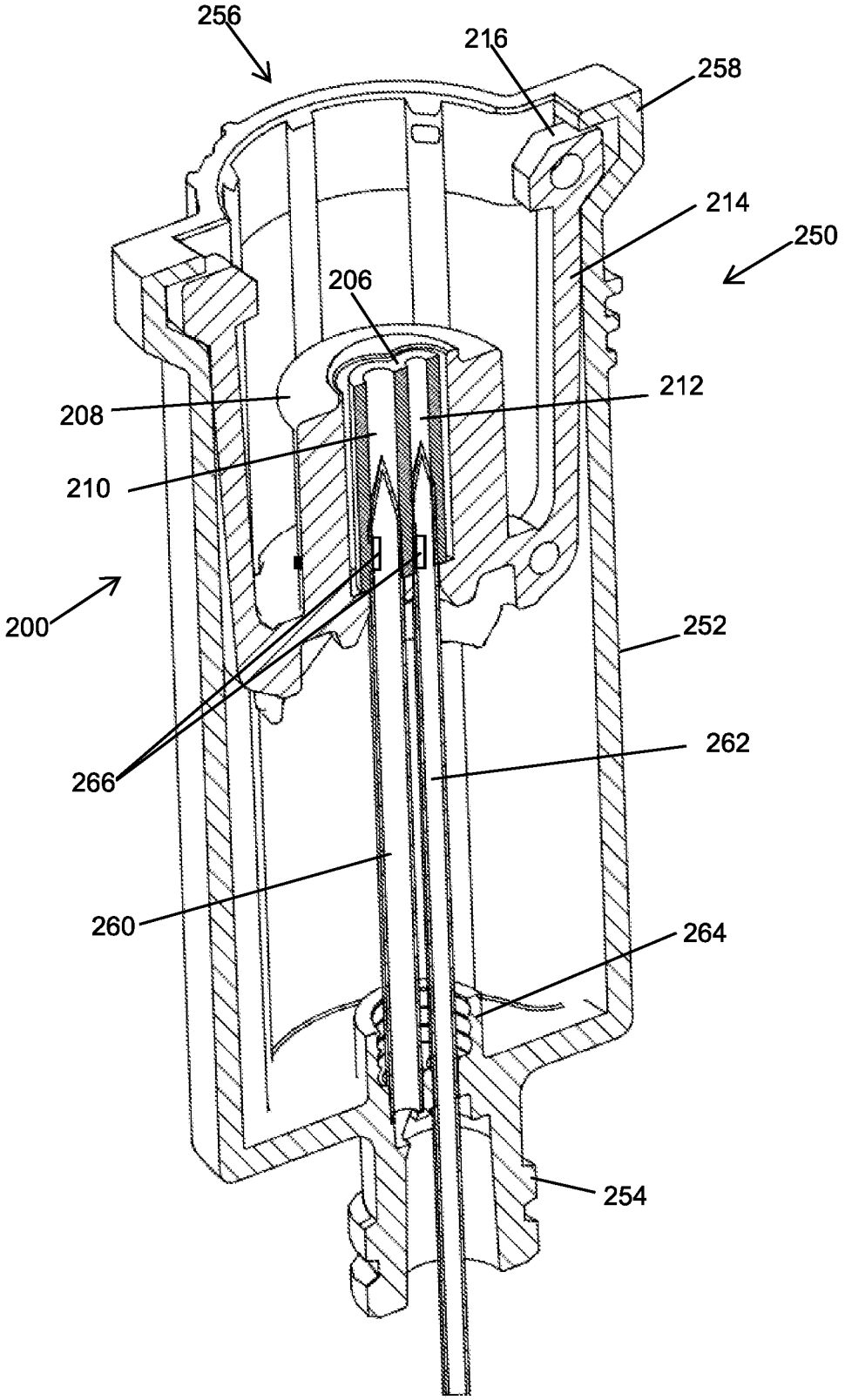
FIG. 5 schematically shows a connector comprising a locking element according to the present invention.

FIG. 5 schematically shows a connector comprising a locking element according to the present invention. Except for locking element 200 that replaces septum holder 700, connector 250 is identical to prior art connector 750 shown in FIG. 3*d*. Connector 250 comprises a hollow cylindrical body 252 that has a closed upper end having a connection arrangement 254, e.g. a luer lock or luer slip connector, on its exterior side to connect to a first component, e.g. a syringe of a fluid transfer system, and a needle holder 264 in the interior side. The body 202 of the locking element 200 is surrounded by the cylindrical body 252 of the connector 250 and is able to slide up and down inside the hollow interior of the cylindrical body 252 of the connector 250. The lower end 256 of cylindrical body 252 is open to allow an end of a second component, e.g. a vial adapter connected to a drug vial, to be inserted into the interior of cylindrical body 252. This end of body 252 comprises shoulder portions 258 into which the enlarged elements 216 of the elongated flexible arms 214 of locking element 200 fit when connector 250 is not connected to a second component of a fluid transfer system, as shown in FIG. 5.

Also see in FIG. 5 are two hollow needles 260 and 262 that respectively function as liquid and air channels through connector 252. Needles 260 and 262 have openings 266 near their pointed distal tips. Openings 266 allow passage of fluid between the interiors and exteriors of the needles. The needles pass through the closed end of connector body 252 and the hollow interior of the upper part 202*a* of the body 202 of the locking element 200 and are fixedly attached to body 252 by needle holder 264.

When connector 250 is not connected to a second component of a fluid transfer apparatus, as shown in FIG. 5, the locking element 200 is at the distal end of connector 250, the distal enlarged elements of the elongated flexible arms of the locking element are fit into shoulder portions at the open lower end of the cylindrical body of the connector, and the tips of needles 260 and 262 are located in the bores 210 and 212 in the insert 206. The insert is made of a resilient material and the diameters of bores 210 and 212 are slightly smaller than the outer diameters of needles 260 and 262. As will be apparent to a skilled person, depending on its intended use, each specific connector may require using a different tolerance in the differences of the diameters in order to balance between the force needed to move the needle so as to maintain user's convenience, and the pressure resistance desired of the valve to prevent leaks, so as to maintain safety. In the configuration shown in FIG. 5, the openings 266 in the sides of the needles are blocked by the interior walls of the bores completely isolating the needles from each other and the outside environment, thereby preventing air from entering the liquid chamber of the syringe or liquid from entering the air chamber even at very high pressures and also preventing exchange of air or liquid with the surroundings.

Figure 6D:
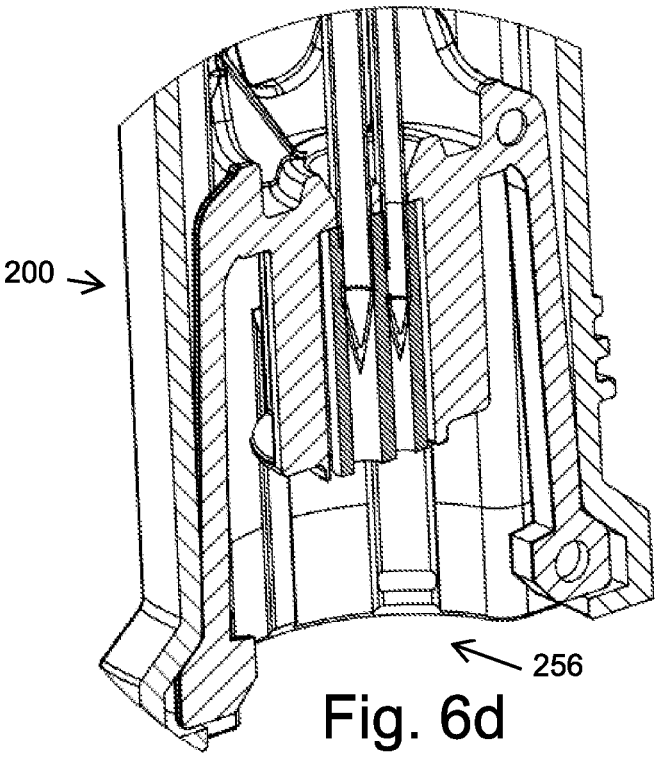
FIG. 6*d* is an magnified view of a section of FIG. 6*c;*
Figure 6C:
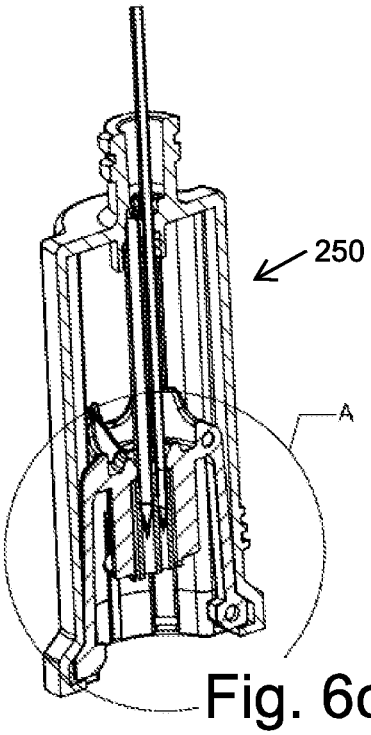
FIG. 6*b* and FIG. 6*c* respectively show views of the interior of the vial adapter and connector of FIG. 6*a;*
Figure 6A:
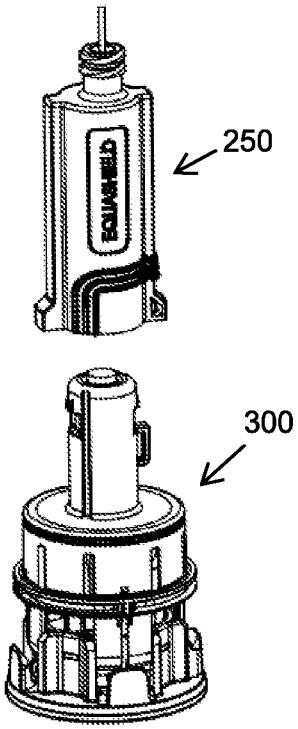
FIG. 6*a* schematically shows a connector of the invention and a vial adapter that will be attached to it.
Figure 6B:
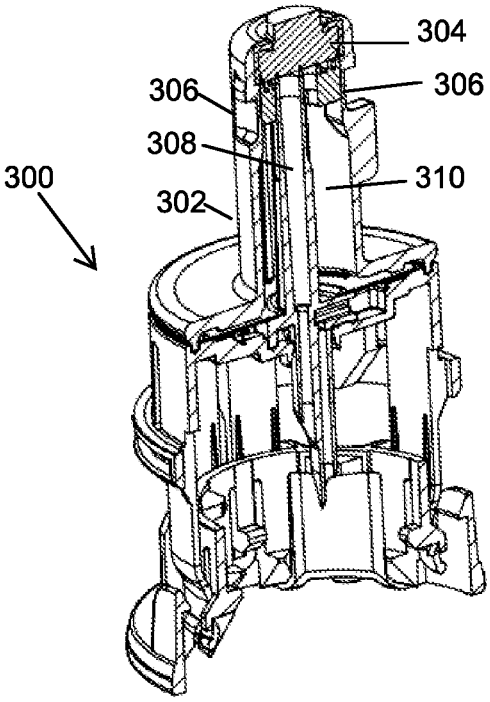

FIG. 6*a* schematically shows a connector 250 of the invention and a vial adapter 300 that will be attached to it. The vial adapter 300 is described in co-pending patent application WO 2014/12264. FIG. 6*b* and FIG. 6*c* respectively show views of the interior of the vial adapter and connector of FIG. 6*a* and FIG. 6*d* is a magnified view of section A in FIG. 6*c*.

Referring to FIG. 6*a* to FIG. 6*d*, the part of the vial adapter that is relevant to describing the present invention is the longitudinal extension 302 that is designed to enter connector 250 through its open end 256 and engage the locking element 200. The top of longitudinal extension 302 is sealed with a septum 304 and on the side of its exterior surface are recesses 306 into which the enlarged elements 216 at the ends of arms 214 of locking element 200 fit when the connector and vial adapter are attached to each other. The interior of longitudinal extension 302 is hollow and acts as an air channel 310. A closed tube that passes through the interior of longitudinal extension 302 functions as a liquid channel 308.

Figure 7C:
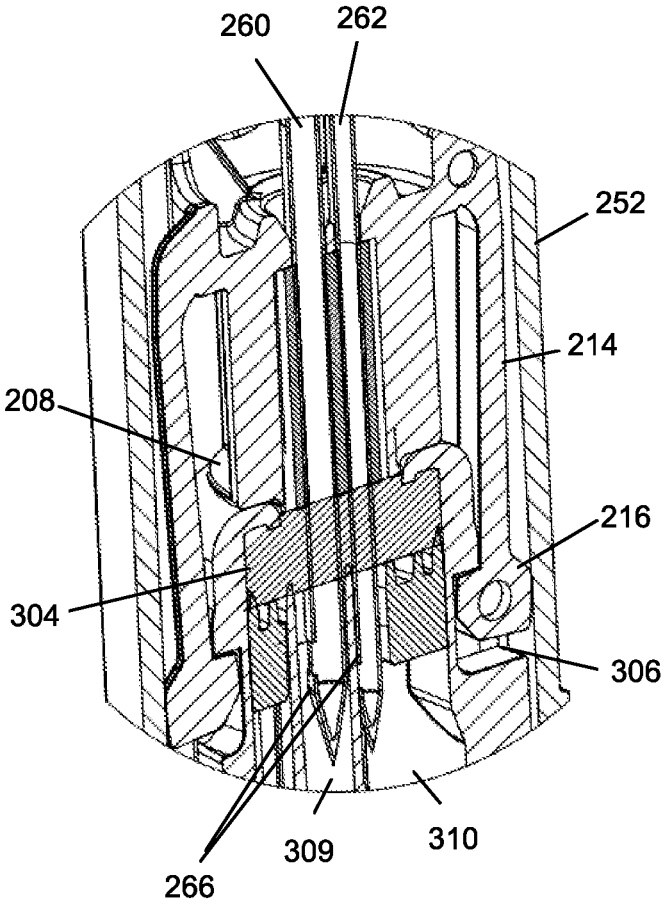
FIG. 7*c* is an magnified view of a section of FIG. 7*b;*
Figure 7B:
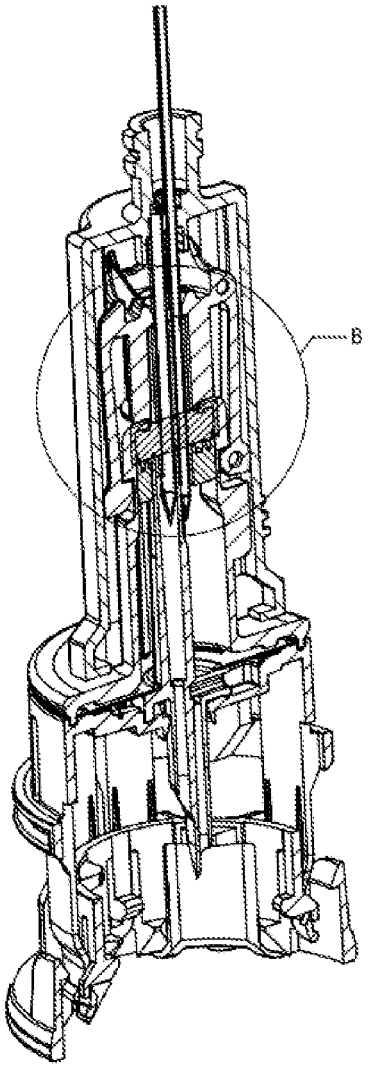
FIG. 7*b* shows a view of the interior of the vial adapter and connector of FIG. 7*a;*
Figure 7A:
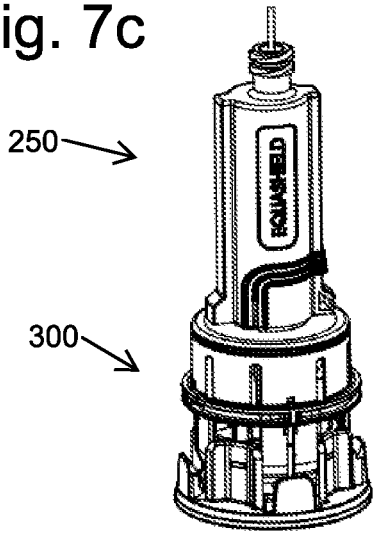
FIG. 7*a* schematically shows the connector of the invention and the vial adapter shown in FIG. 6*a* attached to each other.

FIG. 7*a* schematically shows the connector of the invention and the vial adapter shown in FIG. 6*a* attached to each other. FIG. 7*b* shows a view of the interior of the vial adapter and connector of FIG. 7*a* and FIG. 7*c* is a magnified view of section B in FIG. 7*b*. Referring to these figures and to FIG. 5, when longitudinal extension 302 of vial adapter 300 begins to be pushed into the interior of connector 250, septum 304 at the top of longitudinal extension 302 presses against annular disc 208 at the bottom of locking element 200 forcing the latter to move upwards. At the same time enlarged elements 216 are forced out of shoulder portions 258 at the end of connector 250 and enter the recesses 306 in the longitudinal extension 302. As the locking element is pushed upwards, the enlarged elements 216 are held in the recesses 306 by the interior wall of body 252 of the connector, thereby locking the connector and vial adapter together with septum 304 of the vial adapter pressed tightly against annular disc 208 creating, with no septum in the connector section, the equivalent of the double septum seal of the prior art.

As the locking element 200 and longitudinal extension 302 are pushed up into the interior of the body 252 the tips of needles 260 and 262 are forced out of the bores 210 and 212 in insert 206 and eventually through septum 304. When this happens the openings 266 near the tips of needles 260 and 262 are unblocked and the needles enter liquid channel 308 and air channel 310 in the vial adapter, thereby opening continuous separate liquid and air channels between a drug vial connected to vial adapter 300 to a syringe connected to connector 250.

After the fluid transfer process has taken place connector 250 and drug vial 300 can be separated by pulling them apart in an axial direction. As this is done locking element 200 moves downwards inside the body of connector 250 until the enlarged elements 216 are able to spring back into the shoulder portions 258 at the end of connector 250 and exit the recesses 306 in the longitudinal extension 302 thereby unlocking the vial adapter from the connector. As locking element 200 moves downwards inside the body of connector 250, needles 260 and 262 are pulled upwards through the septum 304 at the top of the vial adapter and into the bores 210 and 212 in insert 206; thereby sealing openings 266 near the tips of the needles. As the needles are pulled through self-sealing septum 304 in the vial adapter, the tips of the needles are wiped clean leaving the external surfaces of both connector and vial adapter clean of drug residue.

Figure 8A:
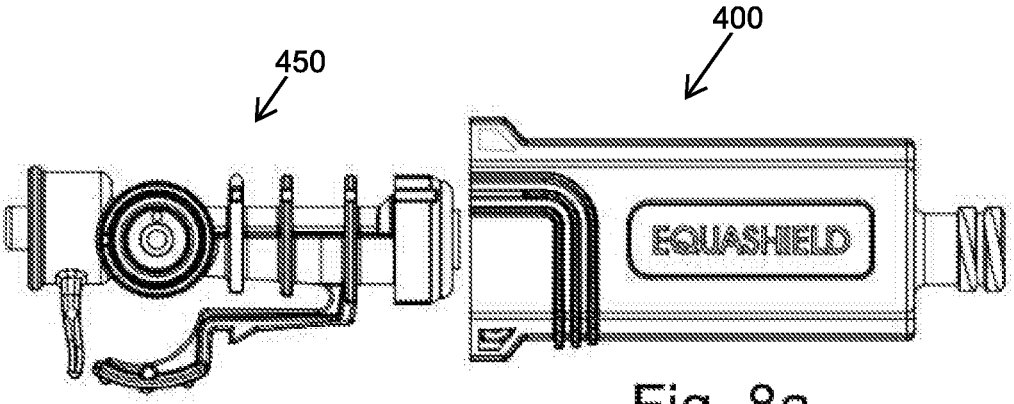
FIG. 8*a* schematically shows an embodiment of a connector according to the invention and a luer lock adapter that are separated from each other.
Figure 8B:
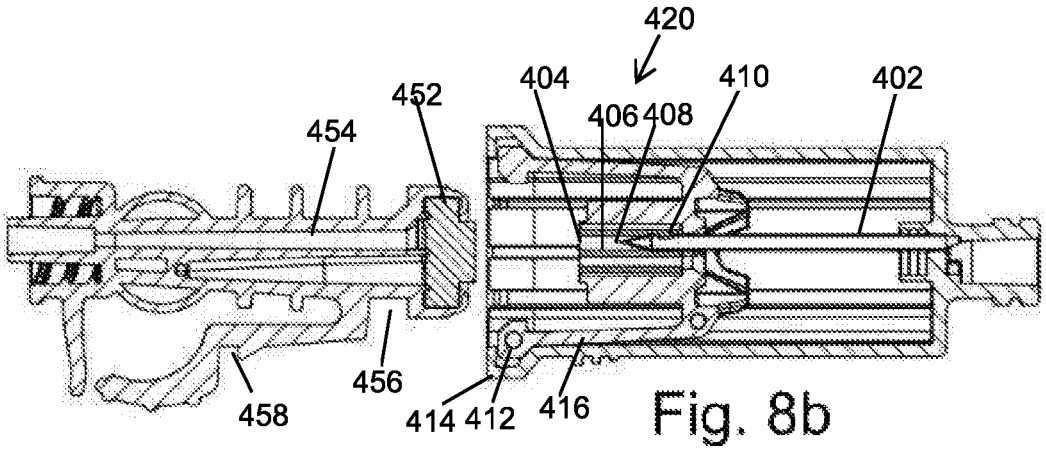
FIG. 8*b* and FIG. 8*d* are respectively cross-sectional views of FIG. 8*a* and FIG. 8*c*.
Figure 8C:
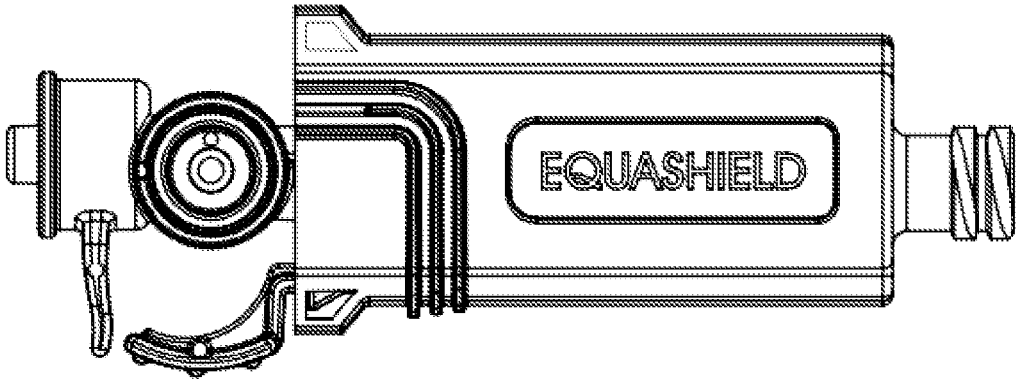
FIG. 8*c* schematically shows the connector and luer lock adapter of FIG. 8*a* connected together.

Many different embodiments of the connector of the invention can be produced. For example FIG. 8*a* schematically shows an embodiment of a connector according to the invention and a luer lock adapter that are separated from each other. FIG. 8*c* schematically shows the connector and luer lock adapter of FIG. 8*a* connected together; and FIG. 8*b* and FIG. 8*d* are respectively cross-sectional views of FIG. 8*a* and FIG. 8*c*.

Luer lock adapter 450 is a product produced by the applicant of the present application to connect to infusion tubing. The features of luer lock adapter 450 that are relevant to the present invention are self-sealing septum 452, liquid channel 454, recesses 456 located near the septum and a trigger-like locking mechanism 458.

In this embodiment connector 400 is very similar in structure to connector 250 but has only one hollow needle 402 that functions as a liquid conduit. Connector 400 comprises a locking element 420 that is very similar in structure to that of locking element 200, including having an annular disc 404 at its end facing the open end of the connector. When not connected to another component, as shown in FIGS. 8*a* and 8*b*, the tip of needle 402 is located inside a bore 408 in insert 406 in locking element 420. The opening 410 near the tip of needle 402 is sealed shut by the resilient material of bore 408 pressing against the exterior of the needle and enlarged elements 412 at the end of the arms of the locking element 420 are located in the shoulder portions 414 at the open end of connector 400. In the embodiment of the locking element shown in FIG. 8*b* the insert has two bores, only one of which is used; however embodiments can easily be made in which the insert has only one bore.

Figure 8D:
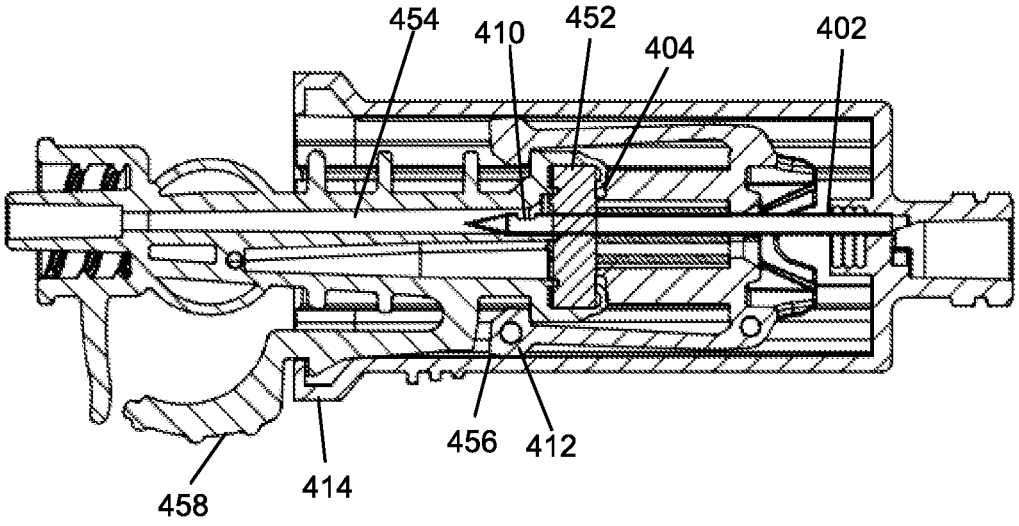

Referring now to FIG. 8*d*, when the end of the luer lock adapter 450 is pushed into the open end of connector 400, the septum 452 in luer lock adapter 450 pushes against the annular disc 404 of the locking mechanism. As locking element 420 moves further inside the body of connector 400, enlarged elements 412 at the end of the arms of the locking element 420 are released from the shoulder portions 414 and eventually settle into recess 456 on the luer lock adapter 450 and the locking mechanism 458 on the luer lock adapter 450 snaps into the shoulder portion 414 of the connector locking adapter and connector together with septum 452 pressed tightly against annular disc 404 creating the equivalent of the double septum seal of the prior art without a septum in the connector. As in the previously described embodiment, as the locking element 420 and attached luer lock adapter are pushed further into the interior of the body of connector 400 the tip of needle 402 i2 forced out of the bore 408 in insert 406 and eventually through septum 452. When this happens the opening 410 near the tip of needle 402 is unblocked and the needle enters liquid channel 454 in the luer lock adapter, thereby opening a continuous liquid channel through luer lock adapter 450 and connector 400.

The fact that the locking element of the present connector does not have a septum at its distal end as is present in all prior art septum holders and connectors that contain them provides the locking element with the following important advantages over the prior art:

1. From the manufacturer's (and ultimately the customer's) point of view the locking element is more cost effective because the number of components and assembly steps are reduced; and
2. From the user's point of view less force is needed to connect the locking element to another component because there is only one septum to pierce as opposed to two with prior art connectors.

The applicant has performed tests to compare connectors comprising the locking element of the invention with prior art connectors that form a double septum seal. The results of these comparison tests show no difference in safety and leak prevention performance.

Although embodiments of the invention have been described by way of illustration, it will be understood that the invention may be carried out with many variations, modifications, and adaptations, without exceeding the scope of the claims.

The invention claimed is:

1. A locking element for a connector configured to connect a first component to a second component of a fluid transfer system, the locking element comprising:

a. a body comprising an upper part having a hollow interior and a lower part having a channel passing through it;

b. elongated flexible arms having distal enlarged elements attached to the sides of the upper part of the body and projecting downwards parallel to the sides of lower part of the body; and c. an insert configured to be inserted into the channel, wherein the insert is made of flexible material and comprises at least one bore passing through it which forms a sleeve through which at least one hollow needle is able to pass;

characterized in that the locking element comprises a rigid flat plastic annular disc at the free end of the lower part of the body; the rigid flat plastic annular disc configured to be pressed tightly against a septum that seals against a proximal end of the second component of the fluid transfer system.

2. The locking element of claim 1, comprising two bores through the insert.

3. A connector configured to connect a first component to a second component of a fluid transfer system, the connector comprising:

a. a hollow cylindrical body that has a closed upper end comprising an exterior side and an interior side, the upper end comprising a connection arrangement on the exterior side and a needle holder on the interior side, the connector configured to connect to the first component of the fluid transfer system;

b. a locking element according to claim 1, wherein the body of the locking element is surrounded by the cylindrical body of the connector and is configured to slide up and down inside the hollow interior of the cylindrical body of the connector;

c. an open lower end of the cylindrical body configured to allow an end of the second component of the fluid transfer system to be inserted into the interior of the cylindrical body;

d. shoulder portions at the open lower end of the cylindrical body into which the enlarged elements of elongated flexible arms of the locking element fit when the connector is not connected to the second component of the fluid transfer system; and e. at least one hollow needle fixedly attached the needle holder, the at least one needle comprising an opening near its distal tip, the opening configured to allow passage of fluid between the interior and exterior of the needle, wherein the at least one needle extends through the hollow interior of the upper part of the body of the locking element into the insert in the at least one bore in the channel in the lower part of the body of the locking element.

4. The connector of claim 3 comprising two hollow needles and two bores through the insert.

5. The connector of claim 3 comprising one hollow needle and one bore through the insert.

6. The connector of claim 3 comprising one hollow needle and two bores through the insert.

7. The connector of claim 3 wherein, when the connector is not connected to the second component of the fluid transfer system, the locking element is at the distal end of the cylindrical body of the connector, distal enlarged elements of elongated flexible arms of the locking element are fit into shoulder portions at the open lower end of the cylindrical body of the connector, and the tips of the needles are located in the bores in the insert, whereupon the openings in the sides of the needles are blocked by the interior walls of the bores thereby completely isolating the needles from each other and the outside environment preventing passage of fluid between the interiors and exteriors of the needles and exchange of fluid with the surroundings.

8. A method of using the connector of claim 3 to provide continuous fluid channels between a first component and a second component of a fluid transfer system, the method comprising:

a) connecting the first component to the connection arrangement on the cylindrical body of the connector;

b) inserting the proximal end of the second component into the open lower end of the cylindrical body of the connector, wherein the second component comprises a septum that seals its proximal end;

c) pushing the connector and the second component together axially until the septum at the proximal end of the second component is pressed tightly against the plastic annular disc at the distal end of the locking element;

d) continue pushing the connector and second component together axially until the locking element and attached second component begin to slide upwards inside the hollow interior of the cylindrical body, thereby forcing the distal enlarged elements of the elongated flexible arms of the locking element to slide out of the shoulder portions at the distal end of the connector into recesses on the side of the exterior surface of the second component thereby attaching the locking element to the second component;

e) continue pushing the connector and second component together axially causing the locking element and attached second component to continue sliding upwards inside the hollow interior of the cylindrical body of the connector until the tips of the needles are pushed out of the bores in the insert of the locking element and through the plastic annular disc at the distal end of the locking element and the septum that seals the proximal end of the second component, whereupon the openings in the sides of the needles are no longer blocked by the interior walls of the bores thereby providing continuous fluid channels between the first component and the second component via the interiors of the needles.

* * * * *